US006835114B2

(12) United States Patent
Sjolander

(10) Patent No.: US 6,835,114 B2
(45) Date of Patent: Dec. 28, 2004

(54) GRINDING TOOL FOR BUTTONS OF A ROCK DRILL BIT

(75) Inventor: Bo Thomas Sjolander, Oakville (CA)

(73) Assignee: C.M.E. Blasting & Mining Equipment Ltd. (CA)

( * ) Notice: Subject to any disclaimer, the term of this patent is extended or adjusted under 35 U.S.C. 154(b) by 0 days.

(21) Appl. No.: 10/240,234

(22) PCT Filed: Apr. 27, 2001

(86) PCT No.: PCT/CA01/00575

§ 371 (c)(1),
(2), (4) Date: Feb. 4, 2003

(87) PCT Pub. No.: WO01/83164

PCT Pub. Date: Nov. 8, 2001

(65) Prior Publication Data

US 2003/0153256 A1 Aug. 14, 2003

(30) Foreign Application Priority Data

Apr. 27, 2000 (CA) ..... 2306735

(51) Int. Cl.[7] ..... B24B 3/33
(52) U.S. Cl. ..... 450/342; 451/359; 451/450
(58) Field of Search ..... 451/450, 48, 53, 451/449, 342–359, 259, 270

(56) References Cited

U.S. PATENT DOCUMENTS 5,637,037 A * 6/1997 Bergquist ..... 451/450
5,885,136 A * 3/1999 Bergqvist ..... 451/53
6,129,619 A * 10/2000 Bergqvist ..... 451/450

* cited by examiner

*Primary Examiner*—Eileen P. Morgan
(74) *Attorney, Agent, or Firm*—Volpe and Koenig, P.C.

(57) ABSTRACT

The present invention provides a grinding cup having a lower grinding cup having a lower grinding section (32) connected to form a grinding cup having top and bottom surfaces. The grinding section is formed from a material capable of grinding the hard materials such as tungsten carbide inserts of button bits etc. A centrally disposed convex recess is formed in the bottom surface having the desired size and profile for the button to be found. Drive means are provided on or in the upper body section that cooperate with the output shaft of the grinding machine. The drive means and the upper body section or grinding section of the grinding cup are adapted to optimize the engagement surfaces and points of contact between the grinding cup and rotor or adapter to reduce negative impact on operational stability and rotor wear, as well as other potential associated wear to the grinding apparatus caused by vibration and/or resonance.

10 Claims, 9 Drawing Sheets

GRINDING TOOL FOR BUTTONS OF A ROCK DRILL BIT

BACKGROUND OF THE INVENTION

The present invention relates to improvements in devices for use as grinding cups for grinding the hard metal inserts or working tips of drill bits (percussive or rotary), tunnel boring machine cutters (TBM) and raised bore machine cutters (RBM) and more specifically, but not exclusively, for grinding the tungsten carbide cutting teeth or buttons of a drill bit or cutter and the means for detachably connecting the grinding cups to the grinding machine.

In drilling operations the cutting teeth (buttons) on the drill bits or cutters become flattened (worn) after continued use. Regular maintenance of the drill bit or cutter by regrinding (sharpening) the buttons to restore them to substantially their original profile enhances the bit/cutter life, speeds up drilling and reduces drilling costs. Regrinding should be undertaken when the wear of the buttons is optimally one third to a maximum of one-half the button diameter.

Different manual and semi-automatic grinding machines are known for grinding button bits/cutters (see for example U.S. Pat. Nos. 5,193,312; 5,070,654). In a conventional type of machine a grinding cup having the desired profile is rotated at high speed to grind the carbide button and the face of the bit/cutter surrounding the base of the button to restore the button to substantially its original profile for effective drilling.

The grinding cups conventionally consist of a cylindrical body having top and bottom surfaces. The bottom or working surface consists of a diamond/metal matrix having a centrally disposed convex recess having the desired profile for the button to be ground. A beveled rim around the recess removes steel from the face of the bit around the base of the button.

Water and/or air, optionally with some form of cutting oil, is provided to the grinding surface to flush and cool the surface of the button during grinding.

The grinding cups are provided in different sizes and profiles to match the standard sizes and profiles of the buttons on the drill bits or cutters. Typically the button diameter varies from 6 mm up to 26 mm.

The grinding cups are conventionally manufactured by first machining a blank. The blank is then pressed into a mould containing a hot diamond/metal mixture. The bottom surface of the blank is heated and bonds to the diamond/metal matrix. Alternatively the diamond/metal matrix can be formed into the grinding section and then bonded either by a shrink fit and/or with adhesives or solder to a blank.

Several different methods are used to connect and retain the grinding cups on to the grinding machine. The grinding cups were conventionally held in the grinding machine by inserting an upright hollow stem projecting from the top surface of the grinding cup into a chuck for detachable mounting of tools. Special tools such as chuck wrenches, nuts and collets are necessary to insert, hold and to remove the grinding cup into and out of the chuck.

To eliminate the need for chuck wrenches etc. the use of a shoulder drive on the grinding cups was developed. A diametrically extending recess at the free end of a hollow drive shaft of the grinding machine co-operates with a shoulder or cam means on the adjacent top surface of the grinding cup. The stem of the grinding cup is inserted into the hollow drive shaft and maybe held in place by one or more O-rings either located in a groove in the interior wall of the drive shaft or on the stem of the grinding cup. See for example Swedish Patent No. B 460,584 and U.S. Pat. No. 5,527,206.

An alternative to the shoulder drive is that shown, for example, in Uniroc AB's Canadian Patent 2,136,998. The free end of the stem of the grinding cup is machined to provide flat drive surfaces on the stem that are inserted into a corresponding drive part in the channel of the output drive shaft into which the stem is inserted. The grinding cup is retained in place by a spring biased sleeve which forces balls mounted in the wall of the output drive shaft into an annular groove on the stem of the grinding cup.

Recent innovations are illustrated in U.S. Pat. No. 5,639,273 and U.S. Pat. No. 5,727,994. In these patents, the upright stem has been replaced with a centrally disposed cavity provided in the top surface of the grinding cup. The cavity is shaped and sized to permit the output drive shaft of a grinding machine to be inserted into the cavity.

Some manufacturers, in order to provide grinding cups that are compatible for use with other manufacturers' grinding machines provide adapters that connect their grinding cup to the output drive shaft of competitors' grinding machines.

Regardless of the method of connecting the grinding cup to the output drive shaft of the grinding machine, the present invention has determined that it is important to optimize the operational stability of the grinding cup. Lack of operational stability often results in vibration and resonance during grinding. Vibration and/or resonance also directly results in increased rates of wear to all moving parts such as bearings, joints, etc. of the grinding apparatus and can potentially interfere with settings within the operating control circuits of the grinding apparatus. In addition, lack of operational stability results in increased wear to all key drive/contact surfaces of the output drive shaft (rotor) and grinding cup which provide consistent, proper alignment between grinding cup and or adapter and the rotor during operation. Operational instability and associated vibration and/or resonance is a major contributor to the deterioration of the preferred built-in profile of the cavity in the grinding section of the grinding cup. This directly results in a deterioration in the profile of the restored button. The net effect being a substantial loss in the intended overall drilling performance of the drill bit or cutter used.

In addition, due to the fact that most grinding cup designs are sized relative to the size and profile of the button to be ground, some grinding cups have protruding and/or irregular features even when engaged with the drive means of the rotor and/or adapter. Other grinding cups, such as those of smaller size, without protruding features, once engaged with the drive means of the rotor, often result in relatively sharp and/or protruding features of the drive means of the rotor being exposed. Some efforts have been made in conventional grinding cups to round off exposed edges on the drive means of grinding cups in an attempt to reduce operator exposure to sharp features. These efforts however have not eliminated the problem of protruding and/or irregular features, but rather attempted to lessen their impact.

SUMMARY OF THE INVENTION

It is an object of the present invention to optimize the engagement surfaces and/or points of contact on the drive means of a grinding cup relative to the corresponding drive and/or contact surfaces of the grinding apparatus rotor or adapter to prevent uneven wear and reduce vibration.

It is a further object of the present invention to reduce negative impact on operational stability, drive/contact surface wear/damage, wear/damage and/or deformation of elastomeric materials in the drive and/or contact areas, as well as other potential associated wear/damage to the grinding apparatus caused by vibration and/or resonance It is a further object of the present invention to improve operational stability by optimizing/harmonizing the forces transferred between the rotor and grinding cup or grinding cup and adapter or adapter and rotor during operation including torsion (rotational) forces, axial (feed) forces and radial (varying side load) forces.

It is a further object of the present invention to minimize operator exposure to sharp and/or protruding features when the grinding cup and rotor have engaged.

It is a further object of the present invention to substantially streamline/harmonize all contact surfaces including the combined outside geometry at the transition point between grinding cups and rotor/adapter.

Accordingly the present invention provides a grinding cup having a lower grinding section and an upper body section connected to form a grinding cup having top and bottom surfaces. Drive means are provided on or in the upper body section that cooperate with the output shaft of the grinding machine. Retaining means are provided in conjunction with the drive means to releasably secure the grinding cup, directly or indirectly with an adapter, to the output shaft of the grinding machine during use. The drive means or upper body section are adapted to reduce negative impact on operational stability, drive/contact surface wear/damage, wear/damage and/or deformation of elastomeric materials in the drive and/or contact areas, as well as other potential associated wear/damage to the grinding apparatus caused by vibration and/or resonance. In addition, substantially reducing vibration and/or resonance will minimize the deterioration of the preferred built-in profile of the cavity in the grinding section. In the preferred design the drive and/or contact surfaces between grinding cup and rotor or adapter are substantially harmonized, minimizing operator exposure to sharp and/or protruding features when the grinding cup and rotor have engaged.

Another aspect of the present invention provides an adapter for releasably connecting a grinding cup to the output shaft of the grinding apparatus. The adapter consists of a holder portion for detachable connection to a grinding cup and a connector portion for releaseable connection to the output shaft of a grinding machine. The holder portion and/or connector portion are adapted to reduce negative impact on operational stability, drive/contact surface wear/damage, wear/damage and/or deformation of elastomeric materials in the drive and/or contact areas, as well as other potential associated wear/damage to the grinding apparatus caused by vibration and/or resonance. In the preferred design the drive and/or contact surfaces between adapter and output shaft or grinding cup are substantially harmonized, minimizing operator exposure to sharp and/or protruding features when the grinding cup and rotor have engaged.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF PREFERRED EMBODIMENTS

Figure 1:
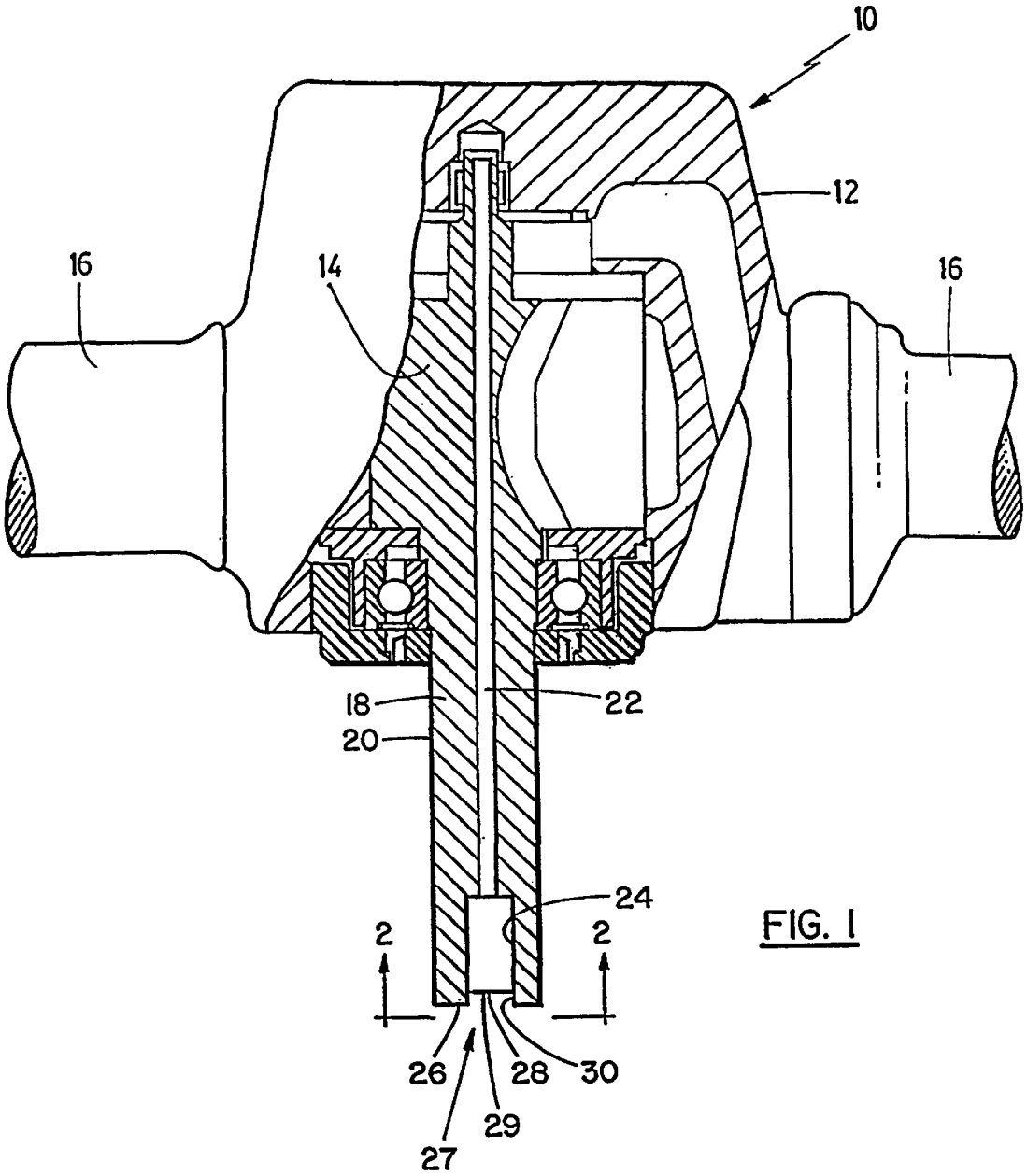
FIG. 1 is a side elevation partly in section of a grinding machine having a single air motor, the rotor of which is adapted to retain a grinding cup having a shoulder drive.
Figure 2:
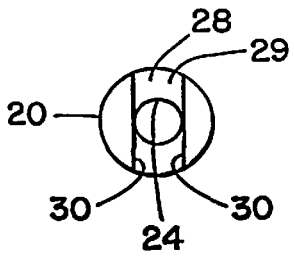
FIG. 2 is a bottom view of the rotor seen in the direction of the line A—A in FIG. 1.
Figure 3:
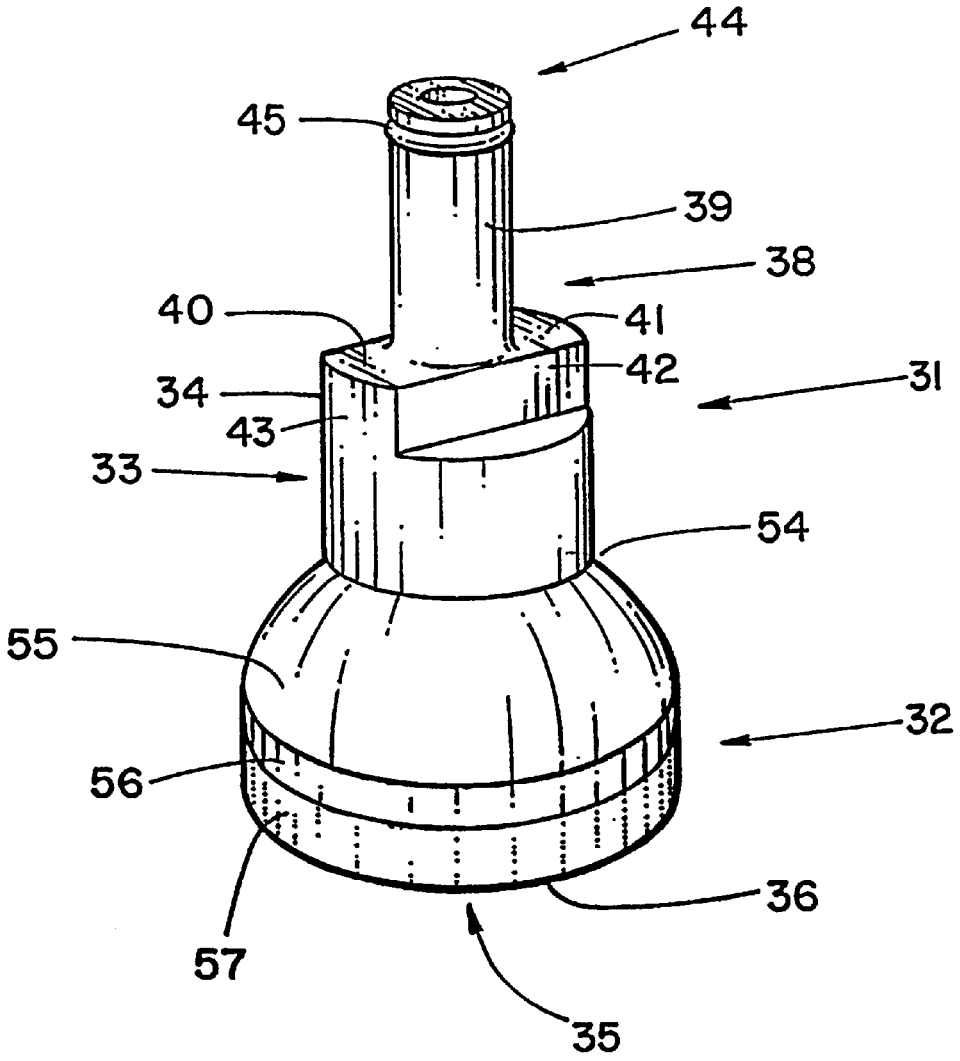
FIG. 3 is an enlarged perspective view of an embodiment of a shoulder drive grinding cup according to the present invention for grinding larger sizes of buttons.
Figure 5:
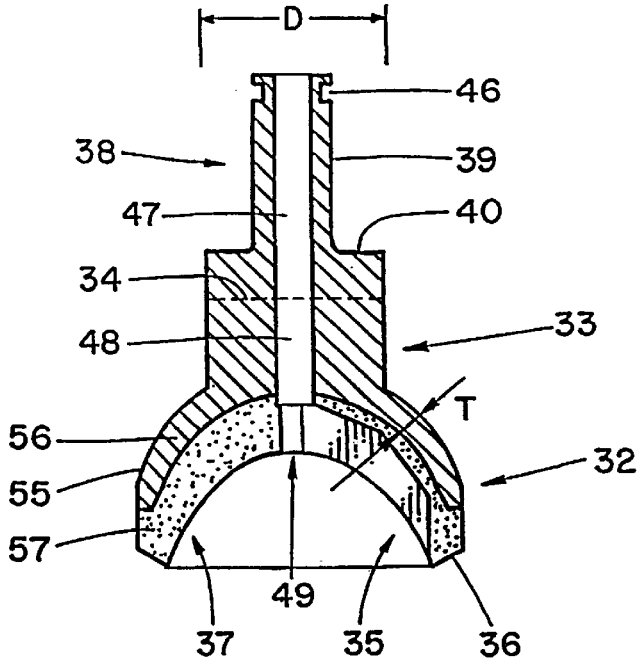
FIG. 5 is a cross section of the grinding cup of FIG. 3 along 5—5.
Figure 4:
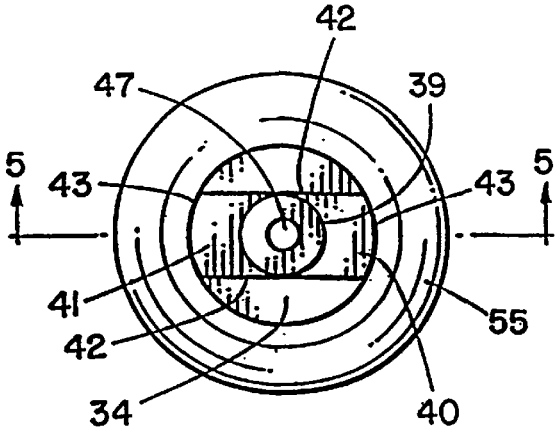
FIG. 4 is a top plan view of the grinding cup of FIG. 3.

The present invention is best illustrated in conjunction with grinding cups utilizing a shoulder drive but is also applicable to other types of drive means on grinding cups or with the use of adapters to connect a grinding cup with one type of drive means to the output drive shaft of a grinding machine having a different type of drive system. FIGS. 1 and 2 show a grinding machine 10 which includes a motor housing or casing 12 within which is suitably supported a rotary motor, the illustrated motor being a pneumatically driven motor 14 adapted to be supplied with compressed air from a suitable source (not shown). The dimensions of the casing 12 are such that the grinding machine may be easily handled manually. It is understood that the present invention also has application for use with automatic and semi-automatic grinding machines, such as those disclosed in U.S. Pat. No. 5,193,312, the manual held machine being illustrated for convenience. The casing is provided with handles 16 projecting outwardly from the casing in a manner that provides maximized ergonomics to the operator. The motor 14 drives an output shaft 18. Suitably connected to the output shaft 18 by any conventional means is a holder device 20 into or onto which the grinding cup or adapter/grinding cup combination may be engaged. In the illustrated embodiment, the holder device 20 is an integral extension of the shaft 18 which constitutes an elongate member. The holder device could also consist of either a separate attachment to the output shaft of the rotor or an adapter to connect a grinding cup having one type of drive means to an output drive shaft having a different type of drive means. For example the adapter could connect a shoulder drive grinding cup to a different output drive shaft such as the hex drive system as illustrated in U.S. Pat. No. 5,639,273 or U.S. Pat. No. 5,727,994 or the drive system illustrated in Canadian Patent 2,136,998. In the device as shown, the shaft 18 and holder device 20 are provided with a coaxial passageway or opening 22 extending the length thereof and through which coolant fluid may be directed to a grinding cup to be supported thereon. An outer portion 24 of the opening 22, extending inwardly from a free end 26 of the holder device 20, is sized snugly, but slidably, to receive a stem of the grinding cup. Interengaging means 27 are provided on the holder device 20 to engage and rotate a grinding cup when in use. In the grinding machine 10 illustrated, the interengaging means 27 consists of a diametrically extending slot 28 in the free end 26 of the output shaft 18. The slot 28 has a top wall 29 and depending substantially parallel side walls 30. The top wall 29 and side walls 30 comprise the drive or contact surfaces on the holder device.

The grinding cups of the present invention have a number of features directed to (1) optimizing the drive surface on the drive means to prevent uneven wear and further reduce vibration to optimize the drive and/or contact surfaces on the drive means of a grinding cup relative to the corresponding drive and/or contact surfaces of the grinding apparatus rotor/adapter to prevent uneven wear and reduce vibration (2) reduce negative impact on wear/damage and/or deformation of elastomeric materials in drive and/or contact areas (3) improving operational stability by optimizing/harmonizing the forces transferred between the rotor and grinding cup during operation including torsion (rotational) forces, axial (feed) forces and radial (varying side load) forces (4) minimizing operator exposure to sharp and/or protruding features when the grinding cup and rotor have engaged (5) substantially streamline/harmonize all contact surfaces including the combined outside geometry at the transition point between grinding cups and rotor/adapter and (6) standardizing components, wherever practical, regardless of the size of the button to be ground to reduce manufacturing costs.

Referring to FIGS. 3–6, one embodiment of a grinding cup according to the present invention is generally indicated at 31. The grinding cup 31 is for use with a grinding machine of the type illustrated in FIGS. 1–2, which incorporates a diametrically extending slot 28 at the free end 26 of the output drive shaft 18 that co-operates with a shoulder or cam means on the adjacent top surface of the grinding cup such as described in U.S. Pat. No. 5,527,206. The grinding cup 31 consists of a lower grinding section 32 and an upper body section 33 connected to form a grinding cup having top and bottom surfaces 34 and 35 respectively. The grinding section 32 is formed from a material capable of grinding the tungsten carbide inserts of button bits. In the preferred embodiment, the grinding section is formed from a metal and diamond matrix. The peripheral edge 36 in the bottom surface 35 is preferably beveled to facilitate the removal of steel from the face of the bit around the base of the button during grinding. A centrally disposed convex recess 37 is formed in the bottom surface 35 having the desired size and profile for the button to be ground.

Figure 6:
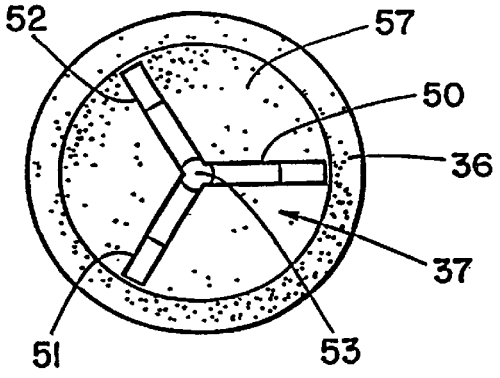
FIG. 6 is a bottom plan view of the grinding cup of FIG. 3.
Figure 7:
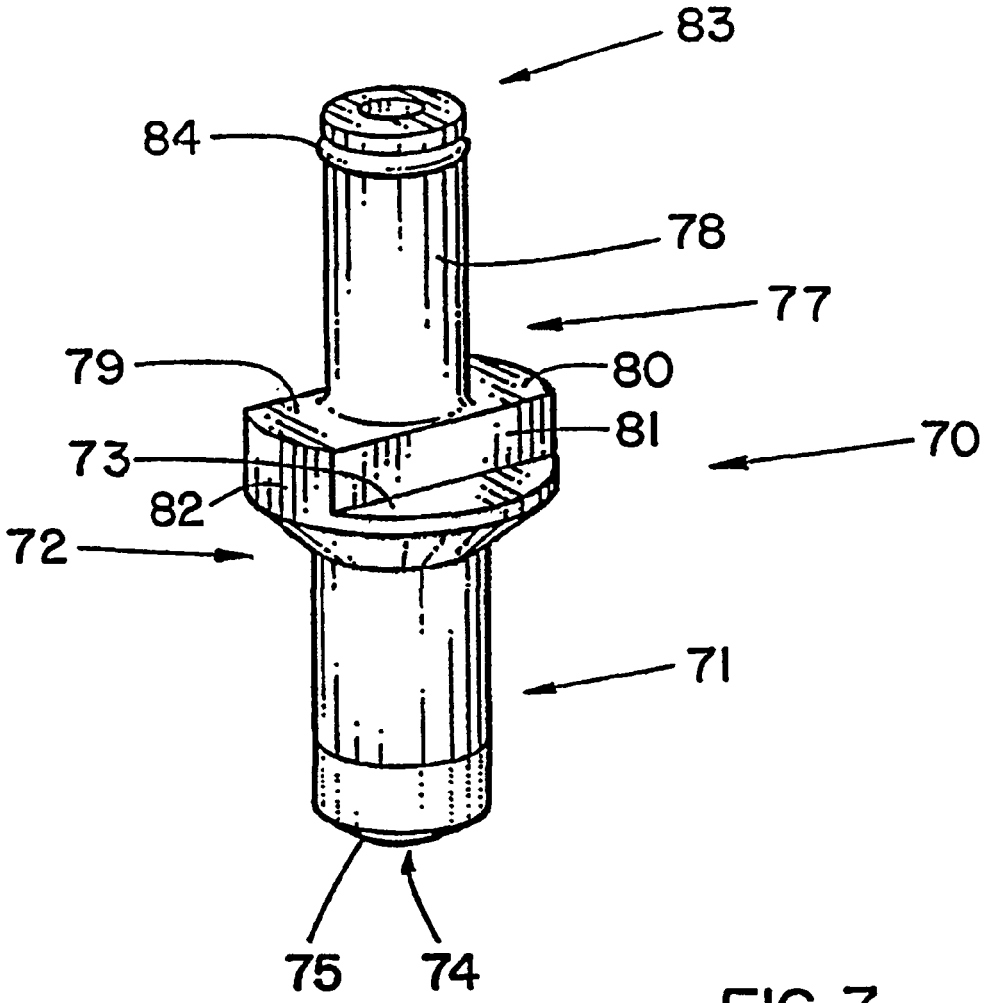
FIG. 7 is an enlarged perspective view of another grinding cup according to the invention for grinding small button bits.
Figure 9:
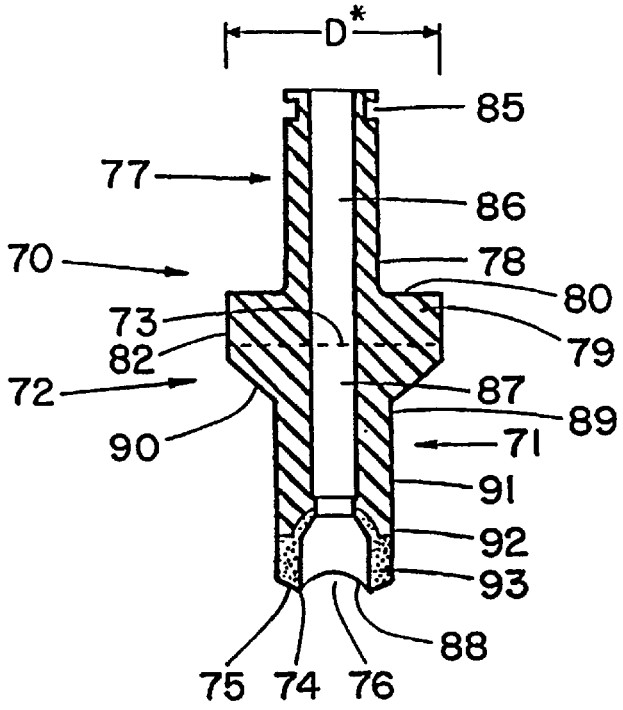
FIG. 9 is a cross section of the grinding cup of FIG. 8 along 9—9.
Figure 8:
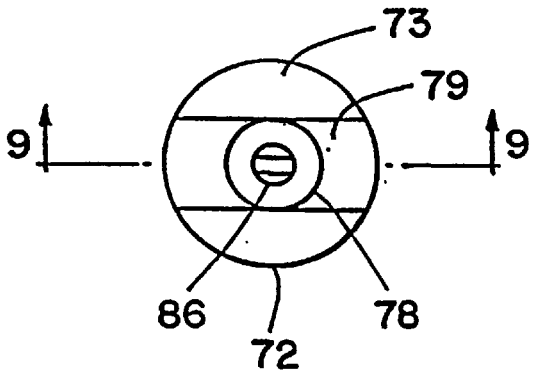
FIG. 8 is a top plan view of the grinding cup of FIG. 7.
Figure 10:
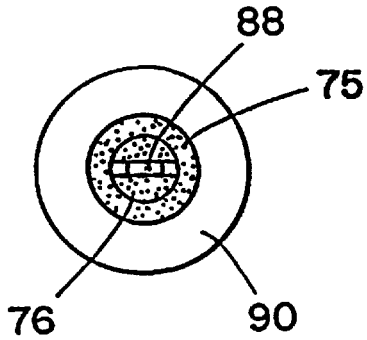
FIG. 10 is a bottom plan view of the grinding cup of FIG. 7.

Drive means 38 are provided on or in the upper body section 33 that cooperate with the output shaft of the grinding machine. In FIGS. 3–6, the drive means 38 consists of a hollow vertical upright stem 39 centrally located on the top surface 34 of the grinding cup 31. Cam means or shoulder 40 is provided at the base of the stem 39 and is sized to engage with the diametrically extending slot 28 at the free end 26 of the output drive shaft 18 of the grinding machine 10 (see FIGS. 1–2). The cam 40 has an upper surface 41, parallel side walls 42 and end walls 43. The hollow stem 39 is inserted into the outer portion 24 of the opening 22 in the holder device 20 of the grinding machine 10. Retaining means 44 are provided in conjunction with the drive means 38 to releasably secure the grinding cup to the output shaft of the grinding machine during use. In the preferred embodiment illustrated in FIGS. 3–6, the retaining means 44 are one or more O-rings 45 located in one or more grooves 46 on the stem 39 of the grinding cup. Optionally the retaining means could also be located on the output drive shaft or a combination on both the grinding cup and the drive shaft working independently or cooperatively. The passageway 47 in stem 39 connects to a corresponding passageway 48 in the body section 33 and grinding section 32 to permit a coolant, preferably water, optionally mixed with cutting oil or a water/air mist, to be provided to the surface of the button during grinding, through one or more outlets 49. As shown in FIG. 6, the outlets 49 in this embodiment consist of three slots 50,51,52 radially extending from the centre 53 of the convex recess 37. The coolant prevents excessive heat generation during grinding and flushes the surface of the button of material removed during grinding. In addition, the diameter of the passageway 48 adjacent to outlets 50–52 may be expanded to facilitate optimized flow between passageway and outlets.

In the embodiment shown, the drive means 38, upper body section 33 and grinding section 32 of the grinding cup 31 are adapted to optimize contact between the engagement surfaces (top surface 41 and side walls 42 of cam 40) on the drive means of the grinding cup and the corresponding engagement surfaces (top wall 29 and side walls 30 of slot 28) on the output drive shaft of the grinding machine to reduce vibration to reduce rotor wear, as well as other potential associated wear to the grinding apparatus caused by vibration and/or resonance and to improve operational stability by optimizing and harmonizing the forces transferred between the rotor/adapter and grinding cup during operation including torsion (rotational) forces, axial (feed) forces and radial (varying side load) forces and to reduce negative impact on operational stability, drive/contact surface wear/damage, wear/damage and/or deformation of elastomeric materials in the drive and/or contact areas.

In the embodiment shown, cam means or shoulder 40 provided at the base of the stem 39 is sized and shaped so that the engagement surfaces on said cam or shoulder are optimized to and match with the corresponding engagement surfaces of slot 28. In addition the cam or shoulder 40 is preferably substantially the substantially the same length, width and depth as the diametrically extending slot 28 at the free end 26 of the output drive shaft 18 of the grinding machine. This optimizes the contact area between the top wall 29 and side walls 30 of slot 28 on the drive shaft and the top surface 41 and side walls 42 of the cam 40 on the grinding cup resulting in reduced vibration and rotor wear, as well as other potential associated wear to the grinding apparatus caused by vibration and/or resonance. Reduced vibration also improves operational stability, drive/contact surface wear/damage, wear/damage and/or deformation of elastomeric materials in the drive and/or contact areas by optimizing and harmonizing the forces transferred between the rotor and grinding cup during operation including torsion (rotational) forces, axial (feed) forces and radial (varying side load) forces. In addition, substantially reducing vibration and/or resonance, minimizes the deterioration of the preferred built-in profile of the cavity in the grinding section.

Standardizing components, wherever practical, regardless of the size of the button to be ground will reduce manufacturing costs and minimize operator exposure to sharp and/or protruding features when the grinding cup and rotor have engaged. In the embodiment illustrated, the diameter D of the top surface 34 of the upper body section 33 and the length D of the cam 40 between end walls 43 is about the same as the length of the diametrically extending slot 28 at the free end 26 of the output drive shaft 18 of the grinding machine. This avoids any sharp or protruding surfaces. In some cases it may be appropriate to have the exterior surface of the free end 26 of the output drive shaft 18 in the vicinity of slot 28 be tapered to further eliminate sharp and/or protruding surfaces while improving accessibility to the grinding cup for faster and easier switching to appropriate size and profile of grinding cup. To optimize and harmonize the various loads such as torsion loads and resulting operational loads such as radial and axial loads over a range of various sizes and profiles of grinding cups, the cam or shoulder may be sized differently in relation to the diametrically extending slot at the free end of the output drive shaft or adaptor if one is being used. In the embodiment shown, because of the size of the tool, the upper body section 33 has a constant diameter throughout its length to the point of contact 54 with the grinding section 32.

To accommodate the diameter of the upper body section 33 relative to the size of the button to be ground, the peripheral surface 54 of the metal portion 56 of grinding section 32 is machined to the point of connection 54 with the upper body section 33 in a profile preferably corresponding to the diamond matrix 57. The thickness T of the metal portion 56 of the grinding section 32 in the area should be sufficient to provide structural support for the diamond matrix 57.

The above noted methods to optimize the contact area between the drive shaft and the grinding cup and standardize components, wherever practical, regardless of the size of the button to be ground will reduce manufacturing costs and minimize operator exposure to sharp and/or protruding features when the grinding cup and rotor have engaged. In addition, this results in less vibration to reduce rotor wear, as well as other potential associated wear to the grinding apparatus caused by vibration and/or resonance and reduces negative impact on operational stability, drive/contact surface wear/damage, wear/damage and/or deformation of elastomeric materials in the drive and/or contact areas by optimizing and harmonizing the forces transferred between the rotor and grinding cup during operation including torsion (rotational) forces, axial (feed) forces and radial (varying side load) forces. In addition, deterioration of the preferred built-in profile of the cavity in the grinding section is minimized. Consideration is given to the size of the grinding cup, the drive means selected, manufacturing costs, areas required for product identification and necessary structural strength and/or support in implementation of the present invention. The present invention does not require in each case all of the possible methods to be employed. Either the drive means and the upper body section or grinding section may be adapted or any combination thereof. Further the invention is applicable to all types of grinding cups regardless of the means used to drive, connect and retain the grinding cup on the grinding machine. The invention is applicable regardless of whether the grinding cup is of the type having an upright hollow step for insertion into a chuck, has a shoulder drive as shown in FIGS. 3–6, is of the type illustrated in U.S. Pat. No. 5,688,163 where the free end of the stem is machined to provide the drive surfaces or is of the type illustrated in U.S. Pat. Nos. 5,639,237 and 5,727,994 or is provided with an adapter that connects one type of grinding cup to an output drive shaft having a different drive system or any modifications or improvements thereon.

FIGS. 7–10 illustrate the application of the present invention with a grinding cup 70 intended to grind small diameter buttons. The grinding cup 70 is for use with a grinding machine which incorporates a diametrically extending slot at the free end of a hollow drive shaft that co-operates with a shoulder or cam means on the adjacent top surface of the grinding cup such as described in U.S. Pat. No. 5,527,206. The grinding cup 70 consists of a lower grinding section 71 and an upper body section 72 connected to form a grinding cup having top and bottom surfaces 73 and 74 respectively. The grinding section 71 is formed from a material capable of grinding the tungsten carbide inserts of button bits. In the preferred embodiment, the grinding section is formed from a metal and diamond matrix. The peripheral edge 75 in the bottom surface 74 is preferably beveled to facilitate the removal of steel from the face of the bit around the base of the button during grinding. A centrally disposed convex recess 76 is formed in the bottom surface 74 having the desired profile for the button to be ground.

Drive means 77 are provided on the upper body section 72 that cooperate with the output drive shaft of the grinding machine. In FIGS. 7–10, the drive means 77 consists of a hollow vertical upright stem 78 centrally located on the top surface 73 of the grinding cup 70. Cam means or shoulder 79, having a top surface 80, depending parallel side walls 81 and end walls 82, is provided at the base of the stem 78 and is sized to engage with a diametrically extending slot 28 (FIG. 1) at the free end 26 of an output drive shaft of the grinding machine. The hollow stem 78 is inserted into the opening 22 in the output drive shaft of the grinding machine. Retaining means 83 are provided in conjunction with the drive means 77 to releasably secure the grinding cup to the output drive shaft of the grinding machine during use. In the preferred embodiment illustrated in FIGS. 7–10, the retaining means 83 are one or more O-rings 84 located in one or more grooves 85 on the stem 78 of the grinding cup. Optionally the retaining means could also be located on the drive shaft or a combination of retaining means located on both the grinding cup and output drive shaft working independently or cooperatively.

The passageway 86 in stem 78 connects to a corresponding passageway 87 in the body section 72 and grinding section 71 to permit a coolant, preferably water, optionally mixed with cutting oil or a water/air mist, to be provided to the surface of the button during grinding, through one or more outlets 88. In addition the diameter of passageway 87 adjacent to outlet 88 may be expanded to facilitate optimized flow between passageway and outlets.

In the embodiment shown, the upper body section 72, grinding section 71 and drive means 77 of the grinding cup 70 are adapted to optimize the engagement surfaces (top surface 80 and side walls 81 of cam 79) on the drive means of the grinding cup with the corresponding contact surfaces (top wall 29 and side walls 30 of slot 28) on the output drive shaft to reduce vibration to thereby reduce rotor wear, as well as other potential associated wear to the grinding apparatus caused by vibration and/or resonance and to improve operational stability by optimizing and harmonizing the forces transferred between the rotor and grinding cup during operation including torsion (rotational) forces, axial (feed) forces and radial (varying side load) forces.

Cam means or shoulder 79 provided at the base of the stem 78 is preferably substantially the same size (height, width and length) as the diametrically extending slot at the free end of the output drive shaft of the grinding machine. This optimizes the contact area between the engaging surfaces on the drive shaft and the grinding cup resulting in reduced vibration and rotor wear, as well as other potential associated wear to the grinding apparatus caused by vibration and/or resonance. Reduced vibration also improves operational stability, drive/contact surface wear/damage, wear/damage and/or deformation of elastomeric materials in the drive and/or contact areas by optimizing and harmonizing the forces transferred between the rotor and grinding cup during operation including torsion (rotational) forces, axial (feed) forces and radial (varying side load) forces. In addition, substantially reducing vibration and/or resonance, minimizes the deterioration of the preferred built-in profile of the cavity in the grinding section.

As noted previously, standardizing components, wherever practical, regardless of the size of the button to be ground will reduce manufacturing costs and minimize operator exposure to sharp and/or protruding features when the grinding cup and rotor have engaged. In the embodiment illustrated, the top surface 73 of the upper body section 72 has a diameter D* about the same as the diameter of the diametrically extending recess at the free end of the hollow drive shaft of the grinding machine. To optimize and harmonize the various loads such as torsion loads and resulting operational loads such as radial and axial loads over a range of various sizes and profiles of grinding cups, the cam or shoulder may be sized differently in relation to the diametrically extending slot at the free end of the output drive shaft or adaptor if one is being used. In the grinding cup illustrated in FIGS. 7–10, the diameter of the body section 72 is reduced by tapering part or all the exterior surface 89 of the upper body section to form a beveled portion 90. Alternatively the reduction of the diameter of the exterior surface 87 can be radial or form a reverse radius. The beveled portion 90 terminates in neck portion 91 that connects to the grinding section 71. In the embodiment illustrated in FIGS. 7–10, neck portion 91 is generally cylindrical with a diameter sufficient to provide structural support for the grinding cup 70.

The grinding section 71, in the embodiment illustrated in FIGS. 7–10 does not have sufficient diameter to have its exterior surface 92 machined in a profile corresponding to the diamond matrix 93 as in FIGS. 3–6.

To optimize volume of coolant delivered to the grinding section 71, the diameter of the passageways 86, 87 through the stem 78 and grinding cup 70 is increased as wide as possible without negatively impacting the structural integrity of the components. In addition the diameter of passageway 87 adjacent to outlet 88 may be expanded to facilitate optimized flow between passageway and outlets.

The above noted methods to optimize the contact area between the drive shaft and the grinding cup and standardize components, wherever practical, regardless of the size of the button to be ground will reduce manufacturing costs and minimize operator exposure to sharp and/or protruding features when the grinding cup and rotor have engaged. In addition, this results in less vibration to reduce rotor wear, as well as other potential associated wear to the grinding apparatus caused by vibration and/or resonance and improves operational stability, drive/contact surface wear/damage, wear/damage and/or deformation of elastomeric materials in the drive and/or contact areas by optimizing and harmonizing the forces transferred between the rotor and grinding cup during operation including torsion (rotational) forces, axial (feed) forces and radial (varying side load) forces. Consideration is given to the size of the grinding cup, the drive means selected, manufacturing costs, areas required for product identification and necessary structural strength and/or support in implementation of the present invention. The present invention does not require in each case all of the possible methods to be employed. Either the drive means and the upper body section or grinding section may be adapted or any combination thereof.

The grinding cups of the present invention can be manufactured in general by the same process conventionally used to make grinding cups: by first forming a blank for the body section by machining, casting, forging etc. To accomplish standardization and reduce manufacturing costs it is desirable to have a standard size of blank. However due the wide range of sizes and profiles of buttons to be ground, it may be possible to standardize over a range of pre-determined sizes. The blank is pressed into a mould preferably containing a hot diamond/metal mixture. The bottom surface of the blank is heated and bonds to the diamond/metal matrix. Several means of heating and bonding the diamond/metal matrix to the blank are known. Alternatively the diamond/metal matrix can be formed into the grinding section and then bonded either by a shrink fit and/or with adhesives or solder to a blank.

The blank for the grinding cup can be machined either before or after it is pressed into the mould containing the hot diamond/metal mixture. The preferred procedure would be to the extent possible pre-machine the blank before attaching the grinding matrix section. In any event some form of post-furnace machining may be required for clean up purposes. Clean up of the exterior surfaces post-furnace is carried out by holding the grinding cup in the chuck of a lathe and then skimming the relevant surfaces wherever needed. At this time it is also possible to remove additional material wherever suitable. Post-furnace machining is used to remove "flash" and other matrix material which may have seeped out of the mold during furnacing/pressing.

Alternative manufacturing methods in order to achieve further standardization, simplify manufacturing, reduce costs and minimize inventory are within the scope of the present invention.

Figure 11:
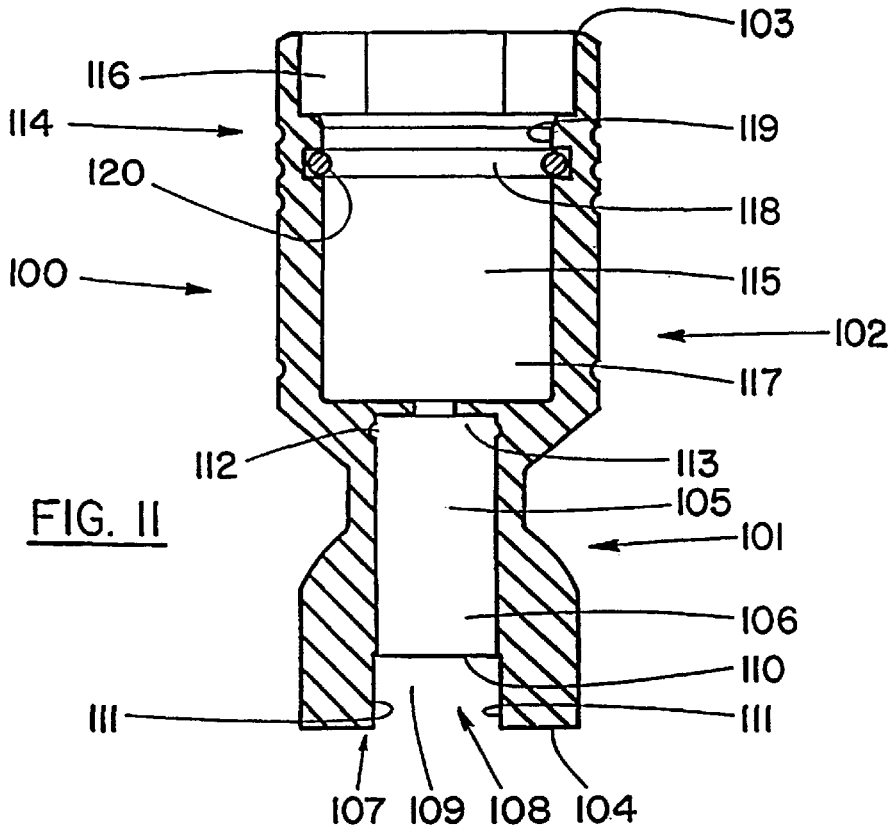
FIG. 11 is a cross-sectional view of an adapter according to the invention.

FIG. 11 illustrates an adapter 100 according to the present invention for attaching a shoulder drive grinding cup as illustrated in FIGS. 3–10 to an output drive shaft employing a hex drive system of the type illustrated for example in U.S. Pat. Nos. 5,639,237 or 5,727,994. The adapter 100 consists of a holder section 101 and an upper body section 102. The holder section 101 and body section 102 are connected to form an adapter having top and bottom surfaces 103 and 104 respectively. The holder section 101 is configured so that the drive means of a shoulder drive grinding cup can be inserted into the adapter and driveably engaged. In the illustrated embodiment, the holder section 101 is provided with a coaxial passageway or opening 105 extending the length thereof. An outer portion 106 of the channel 105, extending inwardly from a free end 107 of the holder section 101, is sized snugly, but slidably, to receive a stem of the grinding cup. Interengaging means 108 are provided on the holder section 101 to driveably engage a grinding cup. In the adapter illustrated, the interengaging means 108 consists of a diametrically extending slot 109 in the free end 107 of the holder section 101. The slot 109 has a top wall 110 and depending substantially parallel side walls 111. The top wall 110 and side walls 111 comprise the drive or contact surfaces on the holder section. A groove 112 in the upper end 113 of passageway 105 is sized to cooperate with an O-ring on the stem of the grinding cup to help retain the grinding cup in place during use. The groove 112 is one point of engagement between the adapter and grinding cup at which forces are transferred.

Drive means 114 are provided in the upper body section 102 that cooperate with the output shaft of the grinding machine. In the embodiment illustrated in FIG. 11, the body section 102 has a centrally disposed cavity 115 formed in the top surface 103 of the adapter. This cavity 115 is shaped and sized to permit the adapter to be detachably connected to the output drive shaft of the grinding machine and rotated during the grinding operation. The end portion of the output drive shaft is adapted to fit within the corresponding sized centrally disposed cavity 115 in the top surface 103 of the adapter 100. The output drive shaft is adapted to driveably engage within cavity 115. In the preferred embodiment shown the top portion 116 of cavity 115 in adapter 100 has a hexagonal cross section. To provide support for the grinding cup and minimize vibration generated axial side load on the adapter, the free end of the output drive shaft is adapted to fit snugly within the bottom portion 117 of cavity 115 in adapter 100. In the embodiment illustrated, both the free end of the output drive shaft and the bottom portion 117 of cavity 115 would have a circular cross section slightly smaller in diameter than the hexagonal drive section 116. Other arrangements are possible, for example the support section of the cavity can be above the drive section located at the bottom of the cavity or the drive section can be located intermediate two support sections.

Retaining means are provided on either the output drive shaft or in the adapter or a combination of both to detachably retain the adapter 100 so that adapter 100 will not fly off during use but can still be easily removed or changed after use. For example in the preferred embodiment shown in FIG. 11 a groove 118 is provided in the wall 119 of cavity 115 into which an O-ring 120 is placed. The O-ring 120 will co-operate with the exterior surface of the output drive shaft to assist in retaining the grinding cup in place during use and reducing vibration and resonance. Additional O-rings on the output drive shaft will co-operate with the wall 119 of the bottom portion 117 of cavity 115 and O-ring 120 to retain the grinding cup in place during use. These grooves and O-rings are points of engagement which work to optimize the transfer of loads between the adapter and the output drive shaft.

In the embodiment shown, the holder section 101 of the adapter 100 is adapted to optimize the engagement or drive surfaces (top surface and side walls of cam) on the drive means of the grinding cup with the corresponding contact surfaces (top wall 110 and side walls 111 of slot 109) on the adapter to reduce vibration to thereby reduce rotor wear, as well as other potential associated wear to the grinding apparatus caused by vibration and/or resonance and to improve operational stability by optimizing and harmonizing the forces transferred between the rotor and grinding cup during operation including torsion (rotational) forces, axial (feed) forces and radial (varying side load) forces.

The slot 109 in adapter 100 is preferably substantially the same size (height, width and length) as the cam or shoulder on the grinding cup. This optimizes the contact area between the adapter and the grinding cup resulting in reduced vibration and rotor wear, as well as other potential associated wear to the grinding apparatus caused by vibration and/or resonance. Reduced vibration also improves operational stability, drive/contact surface wear/damage, wear/damage and/or deformation of elastomeric materials in the drive and/or contact areas by optimizing and harmonizing the forces transferred between the rotor and grinding cup during operation including torsion (rotational) forces, axial (feed) forces and radial (varying side load) forces. In addition, substantially reducing vibration and/or resonance, minimizes the deterioration of the preferred built-in profile of the cavity in the grinding section.

As noted previously, standardizing components, wherever practical, regardless of the size of the button to be ground will reduce manufacturing costs and minimize operator exposure to sharp and/or protruding features when the grinding cup and rotor have engaged. In the embodiment illustrated, the diametrically extending slot 109 at the free end 107 of the holder section 101 of the adapter 100 is about the same size as the diameter of the top surface of the upper body section of the grinding cup. In the adapter illustrated in FIG. 11, the diameter of the body section 102 is reduced by tapering part or all the exterior surface 121 of the upper body section to form a beveled portion 122. Alternatively the reduction of the diameter of the exterior surface 121 can be radial or form a reverse radius. The beveled portion 122 terminates in neck portion 123 that connects to the holder section 101. In the embodiment illustrated in FIG. 11, neck portion 122 is generally cylindrical with a diameter sufficient to provide structural support for the grinding cup.

Figure 12:
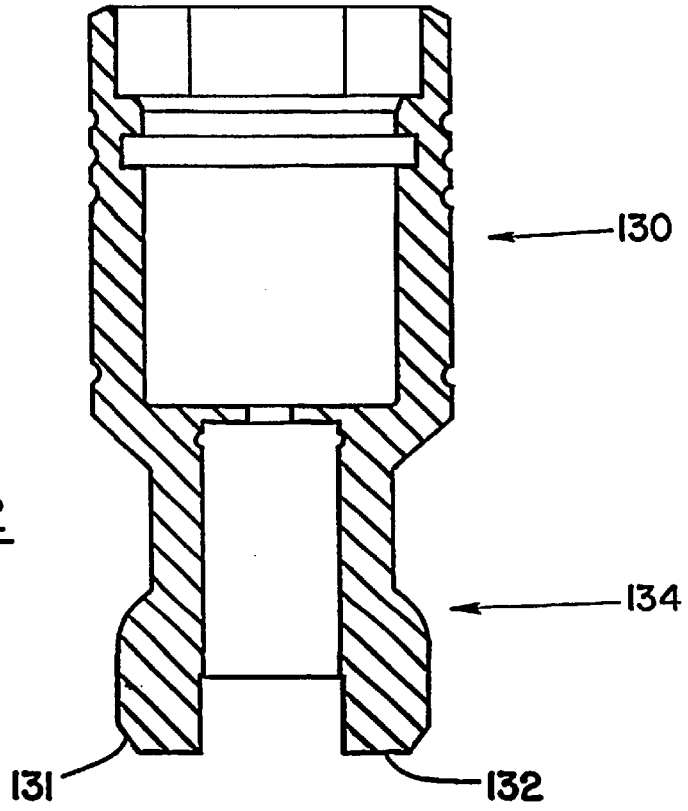
FIG. 12 is a cross-sectional view of another embodiment of an adapter according to the present invention.

FIG. 12 shows another embodiment of an adapter 130 according to the present invention. The adapter 130 is similar to the adapter shown in FIG. 11 except that the peripheral edge 131 of the free end 132 of the holder section 134 of adapter 130 is rounded or beveled to avoid sharp or protruding edges while improving accessibility to the grinding cup for faster and easier switching to appropriate size and profile of grinding cup.

Figure 13:
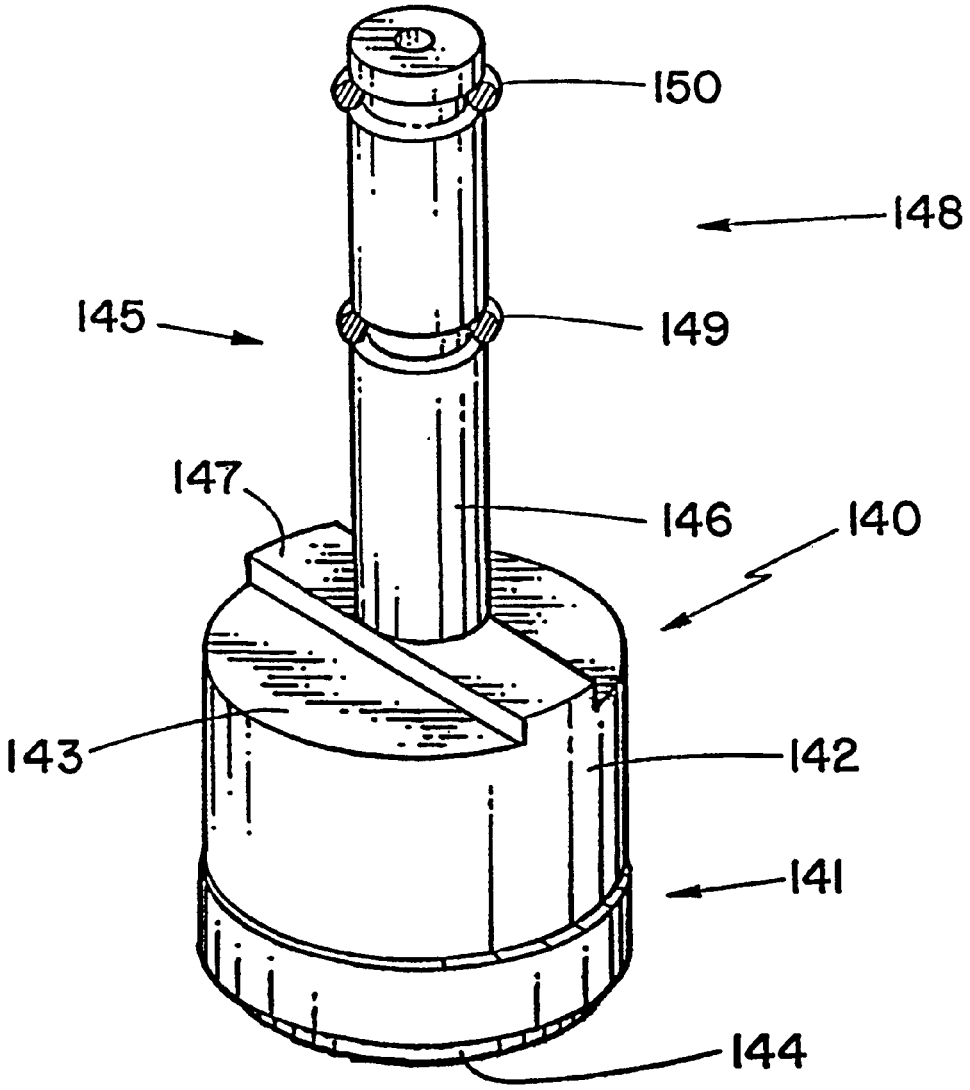
FIG. 13 is an enlarged perspective view of another embodiment of a grinding cup according to the invention.

FIG. 13 illustrates another method of reducing vibration and improving operational stability, drive/contact surface wear/damage, wear/damage and/or deformation of elastomeric materials in the drive and/or contact areas by optimizing and harmonizing the forces transferred between the rotor and grinding cup during operation including torsion (rotational) forces, axial (feed) forces and radial (varying side load) forces. In the embodiment shown, a grinding cup 140 consists of a lower grinding section 141 and an upper body section 142 integrally connected to form a grinding cup having top and bottom surfaces 143 and 144 respectively.

Drive means 145 are provided on the upper body section 142 that cooperate with the output drive shaft of the grinding machine. In FIG. 13, the drive means 145 consists of a hollow vertical upright stem 146 centrally located on the top surface 143 of the grinding cup 140. Cam means or shoulder 147, is provided at the base of the stem 146 and is sized to engage with a diametrically extending slot 28 (FIG. 1) at the free end 26 of an output drive shaft of the grinding machine. The hollow stem 146 is inserted into the opening 22 in the output drive shaft of the grinding machine. Retaining means 148 are provided in conjunction with the drive means 145 to releasably secure the grinding cup to the output drive shaft of the grinding machine during use. In the preferred embodiment illustrated in FIG. 13, the retaining means 148 are two spaced apart O-rings 149, 150 located in grooves on the stem 146 of the grinding cup. Optionally the retaining means could also be located on the drive shaft or a combination of retaining means located on both the grinding cup and output drive shaft working independently or cooperatively. In the embodiment shown the hollow stem 146 is longer than the stem shown for the grinding cups of FIGS. 3–10. The combination of the longer stem and two spaced apart O-rings provides additional support for the grinding cup and further engagement points for optimizing transfer of loads between the grinding cup and the output drive shaft or adapter.

Figure 14:
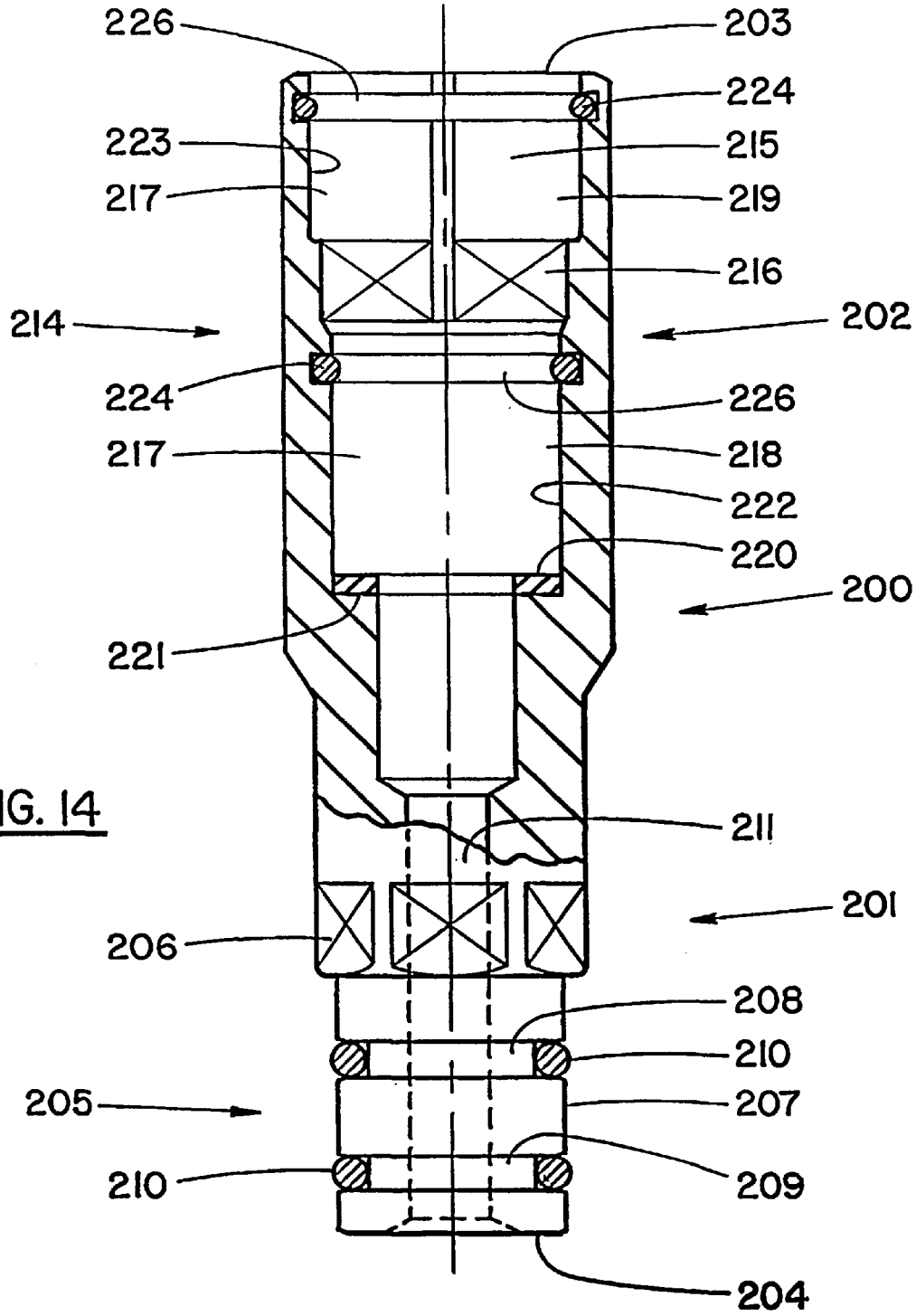
FIG. 14 is a longitudinal cross section of extended form of adapter according to the present invention.

FIG. 14 illustrates the application of utilizing additional support for the grinding cup and further engagement points for optimizing transfer of loads between the grinding cup and the output drive shaft or adapter. FIG. 14 illustrates an extended adapter 200 according to the present invention for attaching a hex drive grinding cup to an output drive shaft employing a hex drive system of the type illustrated for example in U.S. Pat. Nos. 5,639,237 or 5,727,994. The adapter 200 consists of a holder section, generally indicated at 201, and body or connector portion generally indicated at 202. The holder section 201 and connector portion 202 in the embodiment illustrated are connected to form an adapter having top and bottom surfaces 203 and 204 respectively. The holder section 201 is configured so that the end portion 205 of the adapter is adapted to fit within and driveably engage the corresponding sized centrally disposed cavity in the top surface of the grinding cup. In the preferred embodiment shown end portion 205 has an upper drive section 206 and a lower support section 207. In the embodiment shown the upper drive section 206 has a hexagonal cross section but other cross-sections are within the scope of the invention. To provide support for the grinding cup and minimize vibration generated axial side load on the grinding cup, lower support section 207 of the end portion 205 of the adapter 200 is adapted to fit snugly within the bottom portion of the cavity in the top surface of the grinding cup. In the shown embodiment, the lower support section 207 of the adapter 200 has a circular cross section slightly smaller in diameter than the upper drive section 206. While the embodiment shown has an upper drive section and lower support section, other arrangements are possible for example the support section can be above the drive section or the drive section can be located intermediate two support sections.

Retaining means are provided on either the adapter or in the grinding cup to detachably retain the grinding cup so that grinding cup will not fly off during use but can still be easily removed or changed after use. In addition, retaining means can be provided by a combination of both retaining means acting concurrently, cooperatively providing improved retention. For example in the preferred embodiment shown in FIG. 14 a pair of grooves 208, 209 are provided on the lower support section 207 into which O-rings 210 are placed. The O-rings 210 will co-operate with the wall of the support section of the cavity in the top surface of the grinding cup to assist in retaining the grinding cup in place during use and reducing vibration and resonance.

In the illustrated embodiment, the holder section 201 is provided with a coaxial passageway or opening 211 extending the length thereof and communicating with a corresponding passageway or opening 225 in the body portion 202.

Drive means, generally indicated at 214, are provided on or in the body portion 202 that cooperate with the output shaft of the grinding machine. In the embodiment illustrated in FIG. 14, the body portion 202 has a centrally disposed cavity 215 formed in the top surface 203 of the adapter. This cavity 215 is shaped and sized to permit the adapter to be detachably connected to the output drive shaft of the grinding machine and rotated during the grinding operation. The end portion of the output drive shaft is adapted to fit within the corresponding sized centrally disposed cavity 215 in the top surface 203 of the adapter 200. The output drive shaft is adapted to driveably engage within cavity 215. The cavity 215 has a drive section 216 and one or more support sections 217. In the preferred embodiment shown the drive section 216 of cavity 215 in adapter 200 has a hexagonal cross section and two support sections 217, a lower support section 218 and an upper support section 219 are provided with the drive section 216 between said support sections. To provide support for the grinding cup and minimize vibration generated axial side load on the adapter, the free end of the output drive shaft is adapted to fit snugly within the bottom portion 218 of cavity 215 in adapter 200. In the embodiment illustrated, both the free end of the output drive shaft and the bottom support section 218 of cavity 215 would have a circular cross section slightly smaller in diameter than the hexagonal drive section 216. A washer 220 or other elastomeric material is provided at the bottom 221 of lower support section 218 of cavity 215 to provide additional vibration dampening. To provide further support for the grinding cup and minimize vibration generated axial side load on the adapter, a second upper support section 219 is provided within cavity 215 above the drive section 216. The output drive shaft is adapted to fit snugly within the upper support section 219 of cavity 215 in adapter 200. In the embodiment illustrated, both the free end of the output drive shaft and the upper support section 219 of cavity 215 would have a circular cross section slightly larger in diameter than the drive section 216. Other arrangements are possible, for example the support section of the cavity can be above with the drive section located at the bottom of the cavity or the drive section can be located intermediate two support sections as shown.

Retaining means are provided on either the output drive shaft or in the adapter or a combination of both to detachably retain the adapter 200 so that adapter 200 will not fly off during use but can still be easily removed or changed after use. For example in the preferred embodiment shown in FIG. 14 one or more grooves 226 are provided in the walls 222, 223 of the lower support section 218 and upper support section 219 of cavity 115 into which O-rings 224 are placed. The O-rings 224 will co-operate with the exterior surface of the output drive shaft to assist in retaining the grinding cup in place during use and reducing vibration and resonance. Additional O-rings can be provided on the output drive shaft to co-operate with the wall 222 of the bottom support section 218 of cavity 215 and O-rings 224 to retain the grinding cup in place during use. These grooves and O-rings are points of engagement which work to optimize the transfer of loads between the adapter and the output drive shaft.

Figure 15:
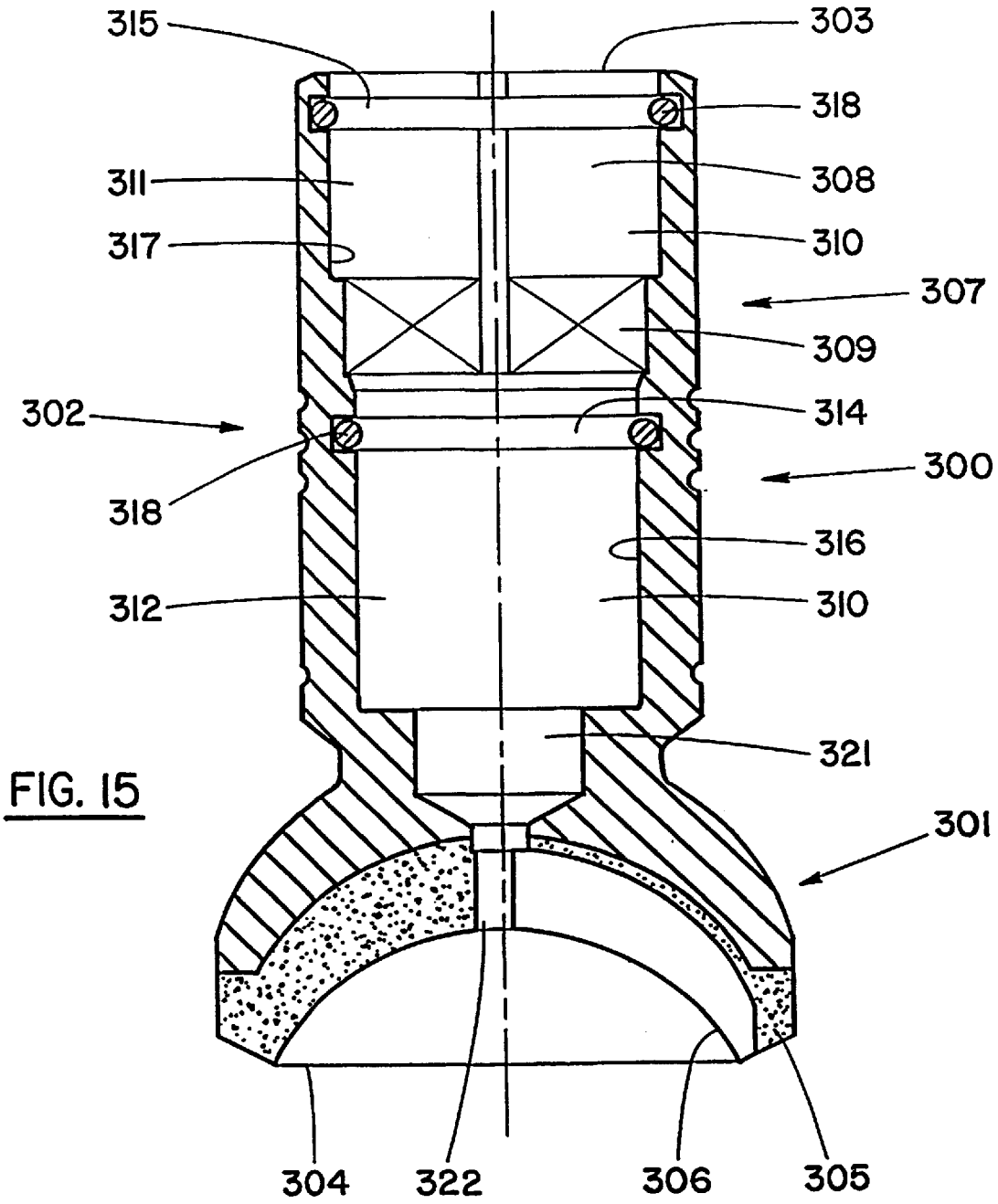
FIG. 15 is a longitudinal cross section of another embodiment of a grinding cup according to the present invention.

The principles of the present invention can be applied to all types of grinding cups including those illustrated in U.S. Pat. Nos. 5,639,237 and 5,727,994. FIG. 15 illustrates another method of reducing vibration and improving operational stability, drive/contact surface wear/damage, wear/damage and/or deformation of elastomeric materials in the drive and/or contact areas by optimizing and harmonizing the forces transferred between the rotor and grinding cup (intended for use with grinders as illustrated in these two patents) during operation including torsion (rotational) forces, axial (feed) forces and radial (varying side load) forces. In the embodiment shown, a grinding cup, generally indicated at 300, consists of a lower grinding section 301 and an upper body section 302 connected to form a grinding cup having top and bottom surfaces 303 and 304 respectively. The grinding section 301 is formed from a material capable of grinding the tungsten carbide button bits. In the preferred embodiment, the grinding section is formed from a metal and diamond matrix. The peripheral edge 305 in the bottom surface 304 is preferably beveled to facilitate the removal of steel from the face of the bit around the base of the button during grinding. A centrally disposed convex recess 306 is formed in the bottom surface 304 having the desired profile for the button to be ground.

Drive means 307 are provided in the upper body section 302 that cooperate with the output shaft of the grinding machine. In the embodiment illustrated in FIG. 15, the upper body section 302 has a centrally disposed cavity 308 formed in the top surface 303 of the grinding cup. This cavity 308 is shaped and sized to permit the grinding cup to be detachably connected to the output drive shaft of the grinding machine or an adapter and rotated during the grinding operation.

The end portion of the output drive shaft is adapted to fit within the corresponding sized centrally disposed cavity 308 in the top surface 303 of the grinding cup 300. The cavity 308 is provided with a drive section 309 and one or more support sections 310. The output drive shaft is adapted to driveably engage within the drive section 309 of cavity 308. In the preferred embodiment shown the drive section 309 of cavity 308 in grinding cup 300 has a hexagonal cross section. In the embodiment illustrated, cavity 308 has two support sections 310: an upper support section 311 and a lower support section 312 with drive section 309 between the support sections. To provide support for the grinding cup and minimize vibration generated axial side load on the grinding cup, the free end of the output drive shaft is adapted to fit snugly within the lower support section 312 of cavity 308 in grinding cup 300. In the shown embodiment, both the free end of the output drive shaft and the lower support section 312 of cavity 308 have a circular cross section slightly smaller in diameter than the drive section 309. Other arrangements are possible for example the support sections of the cavity can both be above the drive section with the drive section located at the bottom of the cavity or vice versa or the drive section can be located intermediate two support sections as shown.

Means are provided in said cavity in the top surface of said grinding cup to reduce vibration and improve operational stability, drive/contact surface wear/damage, wear/damage and/or deformation of elastomeric materials in the drive and/or contact areas by optimizing and harmonizing the forces transferred between the rotor and grinding cup during operation including torsion (rotational) forces, axial (feed) forces and radial (varying side load) forces. In the embodiment illustrated retaining means are provided on either the output drive shaft or in the grinding cup to detachably retain the grinding cup 300 so that grinding cup 300 will not fly off during use but can still be easily removed or changed after use and reduce vibration, improve stability and reduce wear and damage. In addition, retaining means can be provided by a combination of both retaining means acting concurrently, cooperatively providing improved retention, reduced vibration, improved stability and reduced wear and damage. For example in the preferred embodiment shown in FIG. 15 grooves 314, 315 are provided in the walls 316, 317 of the lower support section 312 and upper support section 311 of cavity 308 into which O-rings 318 are placed. The O-rings 318 will co-operate with the exterior surface of the output drive shaft to assist in retaining the grinding cup in place during use and reducing vibration and resonance. Additional O-rings on the output drive shaft will co-operate with the wall 315 of the lower support section 312 of cavity 308 and O-ring 318 to retain the grinding cup in place during use. To further reduce vibration, improve stability and reduce wear and damage it is possible to utilize lighter weight materials such as elastomeric materials in the upper body section of the grinding cup or to form part of the drive means or retaining means.

One or more passageways 321 connect cavity 308 with the recess 306 in the grinding section to permit a coolant, preferably water, optionally mixed with cutting oil or a water/air mist, to be provided to the surface of the button during grinding, through outlets 322. As shown in The drive means 307, upper body section 302 and grinding section 301 of the grinding cup 300 are adapted to reduce vibration and improve operational stability, drive/contact surface wear/damage, wear/damage and/or deformation of elastomeric materials in the drive and/or contact areas by optimizing and harmonizing the forces transferred between the rotor and grinding cup during operation including torsion (rotational) forces, axial (feed) forces and radial (varying side load) forces. The combination of the two support sections and two spaced apart O-rings provides additional support for the grinding cup and further engagement points for optimizing transfer of loads between the grinding cup and the output drive shaft or adapter.

To further reduce vibration and improve operational stability, drive/contact surface wear/damage, wear/damage and/or deformation of elastomeric materials in the drive and/or contact areas by optimizing and harmonizing the forces transferred between the rotor and grinding cup during operation including torsion (rotational) forces, axial (feed) forces and radial (varying side load) forces, it is possible to utilize lighter weight materials such as elastomeric materials in the upper body section of the grinding cup or to form part of the drive means or retaining means.

Having illustrated and described a preferred embodiment of the invention and certain possible modifications thereto, it should be apparent to those of ordinary skill in the art that the invention permits of further modification in arrangement and detail. For example the grinding cup may include an adapter to connect the grinding cup of one drive system to the output drive shaft of a different drive system. The invention is applicable to optimizing the engagement or drive surfaces between the drive shaft and the adapter as well as the adapter and the grinding cup.

It will be appreciated that the above description related to the preferred embodiment by way of example only. Many variations on the invention will be obvious to those knowledgeable in the field, and such obvious variations are within the scope of the invention as described and claimed, whether or not expressly described.

The embodiments of the invention in which an exclusive property or privilege is claimed are defined as follows:

1. A series of grinding cups for grinding working tips of rock drill bits, wherein said working tips have a diameter of about 6 mm to 26 mm and a desired profile, said series of grinding cups being configured for use with an output drive shaft of a grinding machine, comprising:

said series of grinding cups, each grinding cup comprising a lower grinding section and an upper body section connected to form a grinding cup having top and bottom surfaces, a centrally disposed convex recess formed in the bottom surface of said grinding cup having the desired profile and diameter of the working tip, one or more passageways in the upper body section and lower grinding section to permit a coolant to be provided to one or more outlets on the bottom surface of said grinding cup, drive means provided on the upper body section of said grinding cup that cooperates with the output drive shaft, wherein the drive means consists of a hollow vertical upright stem centrally located on the top surface of the grinding cup and cam means provided at the base of the stem sized to engage with a diametrically extending recess at the free end of the output drive shaft, retaining means provided in conjunction with the drive means for detachable connection of the grinding cup to the output drive shaft during use, wherein the cam means on each grinding cup in said series of grinding cups is substantially the same length, width and depth as the diametrically extending recess at the free end of the output drive shaft of the grinding machine to substantially match each grinding cup contact areas on the output drive shaft of the grinding machine, regardless of the diameter of the working tip to be ground.

2. The series of grinding cups according to claim 1 wherein the mass of at least one grinding cup is reduced by incorporating light weight materials in one or more of the upper body section, the drive means, and the retaining means.

3. The series of grinding cups according to claim 2 wherein the light weight material incorporated to reduce the mass of the grinding cup is an elastomeric material.

4. The series of grinding cups according to claim 1 wherein the retaining means consists of two or more spaced apart O-rings located on the hollow vertical upright stem.

5. The series of grinding cups according to claim 4 wherein the length of said hollow vertical upright stem is extended.

6. The series of grinding cups according to claim 1 wherein the diameter of the top surface of each grinding cup in the series of grinding cups is the same as the length of the cam means regardless of the diameter of the working tip of the rock drill bits.

7. The series of grinding cups according to claim 6 wherein the lower grinding section has a peripheral surface, said peripheral surface machined in a profile corresponding to the centrally disposed convex recess.

8. The series of grinding cups according to claim 6 wherein upper body section of the series of grinding cups has an exterior surface, said exterior surface tapered from the top surface of the grinding cup to form a beveled portion, said beveled portion terminating in a neck portion that connects to the lower grinding section.

9. The series of grinding cups according to claim 7 wherein the upper body section of the grinding cups have an exterior surface, said exterior surface tapered from the top surface of the grinding cup to form a beveled portion, said beveled portion terminating in a neck portion that connects to the lower grinding section.

10. The series of grinding cups according to claim 1 wherein the diameter of the passageways through the upper body section and lower grinding section is as wide as possible without negatively impacting on the structural strength of the grinding cup.

* * * * *